US011346050B2

(12) United States Patent
Deltour

(10) Patent No.: US 11,346,050 B2
(45) Date of Patent: May 31, 2022

(54) UNDERWATER MOORING ROPE

(71) Applicant: Bexco N.V., Hamme (BE)

(72) Inventor: Quinten Deltour, Hamme (BE)

(73) Assignee: Bexco N.V., Hamme (BE)

( * ) Notice: Subject to any disclaimer, the term of this patent is extended or adjusted under 35 U.S.C. 154(b) by 0 days.

(21) Appl. No.: 17/252,312

(22) PCT Filed: Jun. 12, 2019

(86) PCT No.: PCT/EP2019/065381
§ 371 (c)(1),
(2) Date: Dec. 15, 2020

(87) PCT Pub. No.: WO2019/243138
PCT Pub. Date: Dec. 26, 2019

(65) Prior Publication Data

US 2021/0262163 A1 Aug. 26, 2021

(30) Foreign Application Priority Data

Jun. 19, 2018 (BE) ..... 2018/5415

(51) Int. Cl.
*D07B 1/20* (2006.01)
*D07B 1/02* (2006.01)

(52) U.S. Cl.
CPC ..... *D07B 1/20* (2013.01); *D07B 1/02* (2013.01); *D07B 2201/1096* (2013.01); *D07B 2201/209* (2013.01); *D07B 2201/2088* (2013.01); *D07B 2205/205* (2013.01); *D07B 2501/2061* (2013.01)

(58) Field of Classification Search
CPC ..... D07B 1/20; D07B 2501/2061
See application file for complete search history.

(56) References Cited

U.S. PATENT DOCUMENTS 1,602,312 A * 10/1926 Qurin ..... D07B 1/02 87/1
3,578,763 A * 5/1971 Platou ..... A01K 75/00 87/6
3,806,568 A * 4/1974 Carlson ..... D07B 1/162 264/45.9

(Continued)

FOREIGN PATENT DOCUMENTS

CN 201228334 Y 4/2009
CN 107326709 A 11/2017

(Continued)

OTHER PUBLICATIONS

"Seile richtig eingesetzt!", Jan. 9, 2009 (Jan. 9, 2009), XP055605422, Retrieved from the Internet: URL:http://www.conacord.de/uploads/Sei1e%20Flyer.pdf.

*Primary Examiner* — Shaun R Hurley
(74) *Attorney, Agent, or Firm* — N.V. Nederlandsch Octrooibureau

(57) ABSTRACT

The present invention relates to a mooring rope for use in subsea mooring, or a substantially synthetic rope thereof, said synthetic rope including a rope core and a layered shell arranged around the rope core, said the shell having a braided outer shell layer. The shell includes sub-surface buoyancy elements, suitable for use in a subsea environment, extending in radial direction between the rope core and the outer shell.

14 Claims, 2 Drawing Sheets

(56) References Cited

U.S. PATENT DOCUMENTS

| | | | | | |
|---|---|---|---|---|---|
| 3,849,929 | A * | 11/1974 | Martuch | A01K 91/00 | 43/44.98 |
| 3,936,335 | A * | 2/1976 | Martuch | A01K 91/00 | 156/79 |
| 4,593,599 | A * | 6/1986 | Yeardley | D07B 1/18 | 294/74 |
| 5,218,016 | A * | 6/1993 | Jarrin | C08K 7/22 | 523/218 |
| 5,341,758 | A * | 8/1994 | Strickland | B63B 34/60 | 114/253 |
| 5,694,755 | A * | 12/1997 | Froystad | D07B 1/20 | 57/211 |
| 5,744,206 | A | 4/1998 | Russek et al. | | |
| 6,085,628 | A * | 7/2000 | Street | D07B 1/20 | 87/7 |
| 6,099,961 | A * | 8/2000 | Del Vecchio | B63B 21/50 | 427/117 |
| 7,568,418 | B2 * | 8/2009 | Kijesky | A62B 1/14 | 87/6 |
| 2010/0162882 | A1 * | 7/2010 | Shakespeare | D04C 1/12 | 87/6 |
| 2013/0247534 | A1 * | 9/2013 | Canedo Duarte da Rocha | D07B 1/064 | 57/220 |
| 2016/0056621 | A1 * | 2/2016 | Patten | H01B 9/006 | 174/40 R |
| 2018/0327968 | A1 * | 11/2018 | Boye Hansen | F16G 11/146 | |
| 2019/0100874 | A1 * | 4/2019 | Patten | F03D 5/00 | |

FOREIGN PATENT DOCUMENTS

| | | | |
|---|---|---|---|
| CN | 206887611 | U | 1/2018 |
| WO | 9325883 | A1 | 12/1993 |

* cited by examiner

UNDERWATER MOORING ROPE

FIELD OF THE INVENTION

The present invention relates to a mooring rope comprising a substantially synthetic rope with a rope core and a shell braided around the core. This invention also relates to a synthetic rope which is provided to form part of such a mooring rope.

BACKGROUND

Unlike wire and chain mooring systems that rely on the weight of the mooring lines to hold the surface production station, synthetic rope mooring systems use the elasticity of the rope to provide the restoring force needed. Synthetic ropes have the advantages that, due to their lower weight, they sag less under their own weight. The most commonly used synthetics are polyester, polyamide, polypropylene, aramid and HMPE (high-molecular polyethylene).

Such synthetic ropes are known from the prior art and comprise a rope core and a shell braided around the core. Because most synthetic ropes will not naturally float in sea water, external buoyancy elements to be attached to the synthetic ropes are required. For example, lace on floats and tubular floats are used to provide the necessary surface buoyancy to the synthetic rope. However, said external buoyancy elements may be easily damaged during use which is not only disrupts offtake service, as the rope is installed and/or taken out-of-service, but is also costly to repair.

Furthermore, underwater mooring rope applications are different from other offshore rope applications. They are long term applications, typically 30 years, and under constant load.

OBJECT OF THE INVENTION

An object of the invention is to improve the known mooring ropes and whether synthetic ropes are provided to form part of such a mooring rope.

Another object of the invention can be to provide a mooring rope that can easily be wound on and off a reel. A further object of the invention can be to improve the bending properties. A still further object of the invention can be to improve the subsea buoyancy. In addition, it may be an object of the invention to provide protection against damage by heat and UV radiation and/or against mechanical damage.

SUMMARY OF THE INVENTION

This object is achieved by a mooring rope for use in subsea mooring, such as permanent mooring ropes or mooring lines, or a substantially synthetic rope thereof. The synthetic rope comprises a rope core and a layered shell arranged around the rope core, said the shell having a braided outer shell layer. The shell comprises substantially rigid sub-surface buoyancy elements, suitable for use in a subsea or underwater environment, extending in radial direction R between the rope core and the outer shell over a height h. As such the buoyancy elements withstand very high water pressure so that they prevent compression in underwater application.

Because the sub-surface buoyancy elements are built into the mooring rope construction, becoming an integral part of the rope, the buoyancy elements do not need to be replaced during the mooring rope's operational service life. This construction makes mooring rope more robust and longer lasting. Furthermore, because the buoyancy elements are suitable for use in an underwater environment, the mooring rope can be designed to float at a pre-determined depth below the water surface/above the sea bed, making the mooring rope suitable for underwater mooring, down to 3000 m and more.

Additionally, the structure of the synthetic rope improves the sub-surface buoyancy performance, raises the impact resistance, enhances the abrasion resistance, improves resistance against UV radiation and prolongs the lifetime of the mooring rope, eliminating the need for spare mooring ropes and expensive maintenance crews.

In a preferred embodiment, these buoyancy elements are block-shaped. In a further preferred embodiment, these block-shaped elements are arranged spirally around the rope core. Preferably, the height is greater than 1 cm, more preferably, the height is less than 10 cm, and still more preferably, the height is about 2.5 cm. The elements preferably have a length of 10-30 cm and/or a width of 2-10 cm.

Due to the presence of buoyancy elements in the shell, the properties of the mooring rope can be adapted to specific requirements by adjusting the properties of the elements or changing the arrangement of the elements. This has the advantage that predetermined properties of the synthetic rope, and therefore the mooring rope, can easily be obtained. These elements can, for example, influence the buoyancy, bending properties, or protection properties of the mooring rope. A further advantage is that mooring ropes with different properties can be manufactured in a similar manner.

In a first aspect, the invention relates to the mooring rope described above, wherein the buoyancy elements are substantially made of a foam material, in particular a foam material with a substantially closed cell structure. Preferably, the buoyancy elements are be made of pressure-resistant subsea foam for use in subsea mooring. Optionally the buoyancy elements are made of a closed cell foam material encapsulated within a protective external skin. Because of the much higher core density of closed cell foams, they are practically rigid whereas open cell foams tend to deform under very small forces.

In a further embodiment, the invention relates to the mooring rope described above, wherein the floating elements are made of foam material with a hydraulic crush point greater than 30 bar. The term "hydraulic crush point" is defined as the pressure (in bar) when a material subjected to an increasing pressure of 1-2 bar/sec has lost 5% of its initial volume.

In further embodiments, the invention relates to the mooring rope described above, wherein the floating elements are made of foam material with a compressive strength greater than 310 kPa, preferably greater than 4.5 MPa, according to the test method ASTM D 1621, a tensile strength greater than 520 kPa, preferably greater than 6.3 MPa, according to the test method ASTM D 1623, a shear strength greater than 280 kPa, preferably greater than 3.2 MPa, according to the test method ASTM C 273, and/or a shear modulus greater than 45 MPa, according to the test method ASTM C 273.

In further embodiments, the invention relates to the mooring rope described above, wherein the floating elements are made of foam material with a density greater than 48 kg/m$^3$ according to the test method ISO 845 or ASTM D 1622. In particular, the floating elements may be made of foam material with a density greater than 180 kg/m$^3$ and/or a density lower than 230 kg/m$^3$, preferably a density around 200 kg/m$^3$.

In a second aspect, the invention relates to the mooring rope described above, wherein the elements are spaced apart in longitudinal direction L and wherein the distance between longitudinally consecutive elements is greater than half the height, preferably greater than the height. In one embodiment, the invention relates to the mooring rope described above, wherein the distance between longitudinally consecutive elements is less than twice the height. Preferably smaller than the height.

Because the elements are placed at sufficient distance from each other, it is possible to bend the synthetic rope such that it can be rolled on a reel (or in a container) for transport.

In another embodiment, the invention relates to the mooring rope described above, wherein the elements tangentially T are spaced apart in a circumferential direction and wherein the distance between tangentially consecutive elements is greater than a quarter of the height. Preferably greater than half the height.

In a third aspect, the invention relates to the mooring rope described above, wherein the rope core comprises at least one subrope and wherein an inner shell is braided around the at least one subrope. Preferably, the rope core further comprises a first filter cover made of filter material provided between the at least one subrope and the inner shell.

In a further preferred embodiment, the invention relates to the mooring rope described above, wherein the intermediate shell comprises at least one element sheeth provided between the rope core and the elements for carrying the buoyancy elements. Preferably, the rope core further comprises a second filter cover of filter material provided between the elements and the outer shell.

In embodiments, the invention relates to the mooring rope described above, wherein the outer shell is substantially cylindrical, i.e. having a substantially constant cross-sectional area, and preferably has a circular cross-sectional area. Because the synthetic rope has the same cross-section everywhere, the synthetic rope has a substantially even outer surface in the longitudinal direction. This has the advantage that the synthetic rope can easily be rolled on and off a reel.

In one embodiment, the invention relates to the mooring rope described above, wherein the synthetic rope extends longitudinally over at least 10% of a length of the mooring rope. The synthetic rope preferably extends over at least 25% of the length of the mooring rope, even more preferably over at least 50% or 75% of the length of the mooring rope. Because the synthetic rope extends over a substantial part of the mooring rope, excluding the ends, mainly the synthetic rope will determine the shape of the mooring rope. If the synthetic rope has a substantially even structure, then the mooring rope also has a substantially even structure, possibly with the exception of the ends. This makes rolling up and/or unrolling the entire mooring rope easier.

The invention further relates to a synthetic rope for use in the mooring rope described above and a method for manufacturing the mooring rope by winding at least one element sheeth carrying buoyancy element around the rope core.

BRIEF DESCRIPTION OF DRAWINGS

The invention will be explained in more detail below with reference to drawings in which illustrative embodiments thereof are shown. They are intended exclusively for illustrative purposes and not to restrict the inventive concept, which is defined by the appended claims.

Figure 1:
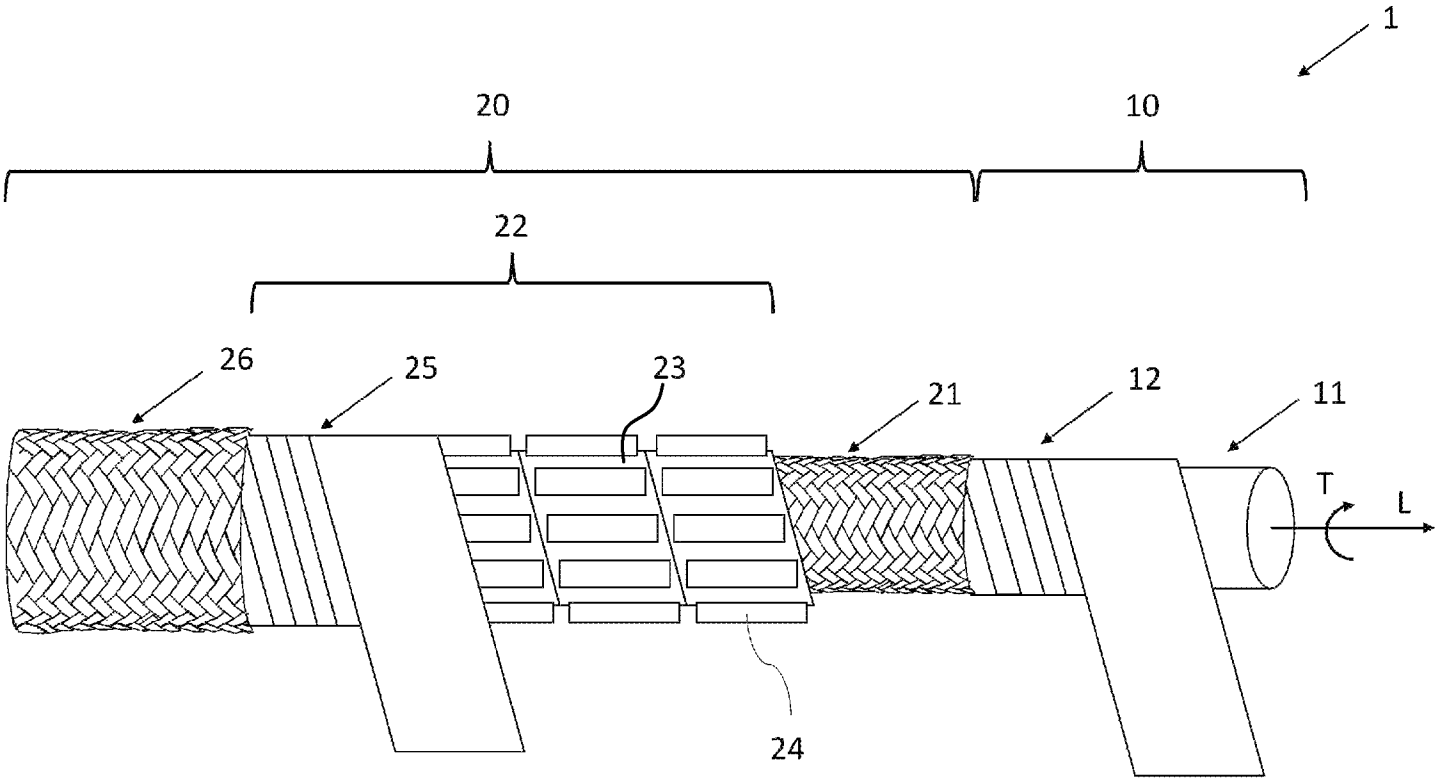
FIG. 1 shows in a cut-away view a simplified representation of a synthetic rope, for use in a mooring rope, according to an embodiment of the invention.

Other alternatives and equivalent embodiments of the present invention are conceivable within the idea of the invention, as will be clear to the person skilled in the art. The scope of the invention is limited only by the appended claims.

DETAILED DESCRIPTION OF EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

In a preferred embodiment of a mooring rope according to the present invention, a synthetic rope 1, as shown in FIG. 1, is provided with a loop or eye on at least one end. Such eyes are known from the prior art and are not described further here.

Figure 2:
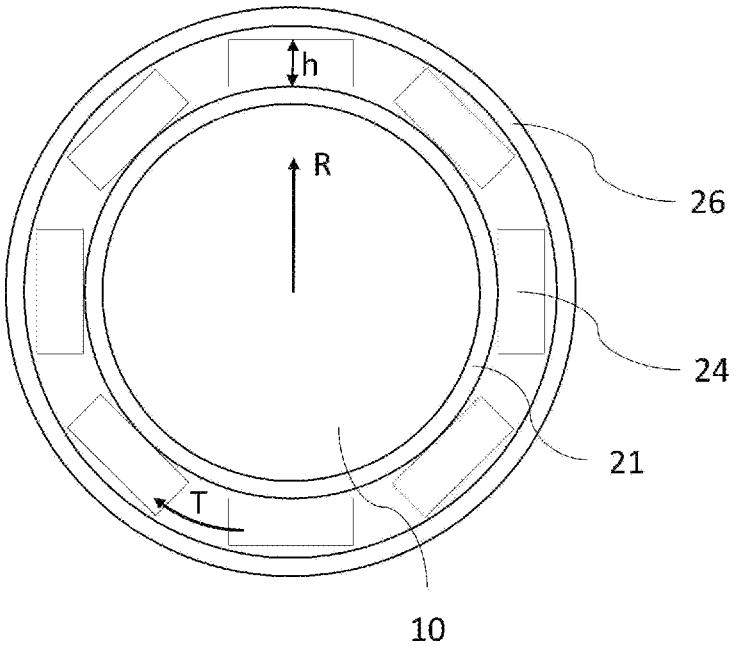
FIG. 2 shows a cross-section through the mooring rope shown in FIG. 1.

The synthetic rope 1 which forms part of this preferred embodiment comprises in a radial direction R, as shown in FIG. 2, a rope core 10, a shell 20 with an inner shell layer 21, an intermediate shell layer 22 and an outer shell layer 26.

The rope core 10 is made up of at least one subrope 11 which is wound in a first filter cover 12 consisting of a 6-fold layer of a filter material. The at least one rope 11 can be designed as a 3, 4 or 6-strand twisted rope or as 8 or 12-strand braided rope, or double braided rope. In a specific embodiment, the rope core 10 can be composed of a bundle of subropes 11 which are wound in the first filter lining 12. These subropes can each be formed as 3, 4 or 6-strand twisted ropes or as 8 or 12-strand braided ropes. This rope core 10 defines a longitudinal direction L, the radial direction R and a tangential direction T of the synthetic rope. Several strands are braided around the rope core 10 to form a continuously seamless inner shell layer 20. The inner rope structure, i.e. the rope core 10 and the inner shell layer 21, are wound in an intermediate shell layer 22 constructed from a sheeth 23 with floating elements 24 and a second filter cover 25 consisting of a single or multiple layer of a filter material. Several strands are braided around the intermediate shell layer 22 to form a continuously seamless outer shell layer 26. Preferably, this synthetic rope 1 is made from polyester, but it can equally well be made from another synthetic or from a combination of different synthetics.

The filter covers 12, 25 prevent sand grains or other abrasive particles larger than 5 μm from falling between the strands, even when the rope 1 lies at a great depth on the bottom of the sea. Water can pass through the filter coating so that this filter coating does not crack under the influence of hydrostatic pressure. The filter material can be, for example, a non-woven fabric or a geo-textile, or other suitable material insofar as it has the appropriate permeability and filter effect.

The filter covers 12, 25 consisting of a multiple layer of a filter material can be formed by one strip of overlapping wound filter material or by a plurality of strips of themselves little to non-overlapping wound filter material, the windings of the plurality of strips being shifted in the longitudinal direction. The strips can for instance be wound helically. The floating elements 24 are suitable for underwater purposes. These underwater floating elements must withstand very high water pressure, and consequently have a high compressive strength, so that they prevent distortion in underwater application. In underwater application, the buoyancy elements 24 provide buoyancy.

Preferably, the floating elements 24 are made of a foam material with a closed cell structure and a hydraulic compressive strength, hydraulic crush point, greater than 30 bar.

The invention claimed is:

1. A subsea mooring rope, comprising:

a substantially synthetic rope comprising a rope core and a layered shell arranged around the rope core, said layered shell having a braided outer shell layer, wherein the layered shell comprises sub-surface buoyancy elements extending radially between the rope core and the outer shell layer over a height, wherein the buoyancy elements are made of foam material with a hydraulic crush point greater than 30 bar, wherein the space formed between successive buoyancy elements is filled with air or water.

2. The subsea mooring rope according to claim 1, wherein the buoyancy elements are made of foam material with a compressive strength greater than 310 kPa, a tensile strength greater than 520 kPa, and a shear strength greater than 280 kPa.

3. The subsea mooring rope according to claim 2, wherein the distance between longitudinally consecutive buoyancy elements is greater than a quarter of the height.

4. The subsea mooring rope according to claim 1, wherein the buoyancy elements are made of foam material with a density greater than 180 kg/m$^3$.

5. The subsea mooring rope according to claim 1, wherein the buoyancy elements are positioned longitudinally spaced apart and wherein the distance between longitudinally consecutive buoyancy elements is smaller than twice the height.

6. The subsea mooring rope according to claim 1, wherein the buoyancy elements are arranged tangentially spaced apart and wherein the distance between tangentially consecutive buoyancy elements is greater than a quarter of the height.

7. The subsea mooring rope according to claim 1, wherein the rope core comprises at least one subrope, wherein an inner shell layer is braided around the at least one subrope.

8. The subsea mooring rope according to claim 7, wherein the rope core further comprises a first filter cover made of filter material provided between the at least one subrope and the inner shell layer.

9. The subsea mooring rope according to claim 1, wherein the shell layer further comprises an element sheet extending between the rope core and the buoyancy elements for connecting and supporting the buoyancy elements; and/or comprises a second filter cover made of filter material extending between the buoyancy elements and the outer shell layer.

10. The subsea mooring rope according to claim 1, wherein the mooring rope is substantially cylindrical shaped over at least 75% of its length; and/or wherein the substantially synthetic rope is substantially cylindrical shaped.

11. The subsea mooring rope according to claim 1, wherein the substantially synthetic rope extends longitudinally over at least 10% of a length of the mooring rope.

12. A method for manufacturing the subsea mooring rope according to claim 1, comprising the steps of forming a substantially synthetic rope (1) by:

a) providing a rope core;

b) providing an elongated sheet, made of a fabric or a textile, having sub-surface buoyancy elements arranged spaced apart in the longitudinal direction of the elongated sheet; and c) winding the elongated sheath around the rope core to form a rope assembly;

d) braiding an outer shell layer (26) around the rope assembly.

13. The subsea mooring rope according to claim 1, wherein the space between the rope core and the outer shell layer consists of spaced apart buoyancy elements of a single type of foam material with a hydraulic crush point greater than 30 bar.

14. A substantially synthetic rope, comprising a rope core and a layered shell arranged around the rope core, said layered shell having a braided outer shell layer, wherein the layered shell comprises sub-surface buoyancy elements extending radially between the rope core and the outer shell layer over a height, and wherein the buoyancy elements are made of foam material with a hydraulic crush point greater than 30 bar, wherein the space formed between successive buoyancy elements is filled with air or water.

* * * * *